US011141737B2

(12) United States Patent
Pausch

(10) Patent No.: US 11,141,737 B2
(45) Date of Patent: Oct. 12, 2021

(54) AGITATOR BALL MILL WITH AXIAL CHANNELS

(71) Applicant: NETZSCH-Feinmahltechnik GmbH, Selb (DE)

(72) Inventor: Horst Pausch, Schwarzenbach an der Saale (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 163 days.

(21) Appl. No.: 16/534,476

(22) Filed: Aug. 7, 2019

(65) Prior Publication Data

US 2019/0358639 A1 Nov. 28, 2019

Related U.S. Application Data

(63) Continuation of application No. 14/978,763, filed on Dec. 22, 2015, now Pat. No. 10,610,871, which is a (Continued)

(30) Foreign Application Priority Data

Jul. 8, 2013 (DE) ..... 102013107190.2

(51) Int. Cl.
*B02C 17/16* (2006.01)

(52) U.S. Cl.
CPC ..... *B02C 17/161* (2013.01); *B02C 17/163* (2013.01)

(58) Field of Classification Search
CPC ..... B02C 17/161; B02C 17/163; B02C 17/16
See application file for complete search history.

(56) References Cited

U.S. PATENT DOCUMENTS 3,050,263 A * 8/1962 Barkman ..... B02C 17/16 241/30
4,513,917 A * 4/1985 Szkaradek ..... B02C 17/163 241/172

(Continued)

FOREIGN PATENT DOCUMENTS

CN 201950477 U 8/2011
CN 202202545 U 4/2012

(Continued)

OTHER PUBLICATIONS

U.S. Office Action U.S. Appl. No. 14/978,763 dated Oct. 23, 2019 7 Pages.

(Continued)

*Primary Examiner* — Faye Francis
(74) *Attorney, Agent, or Firm* — Whitmyer IP Group LLC

(57) ABSTRACT

A stirred ball mill including a grinding container, in which an agitator shaft having grinding elements is arranged, whereby a grinding chamber is formed between the grinding container and the agitator shaft, into which chamber the grinding elements extend and into which at least one inlet duct for grinding material opens and in which a dynamic separation device for grinding bodies is provided, the separation device having recesses for feeding back the grinding bodies, and in which the agitator shaft has at least one recess, which widens the separation device and extends in the axial direction into the grinding chamber for improved distribution of the grinding bodies in the grinding chamber.

16 Claims, 9 Drawing Sheets

Related U.S. Application Data continuation of application No. PCT/DE2014/000330, filed on Jun. 25, 2014.

(56) References Cited

U.S. PATENT DOCUMENTS 4,932,166 A * 6/1990 Boecker ..... B02C 17/16 51/293
5,333,804 A * 8/1994 Liebert ..... B02C 17/16 241/172
5,474,237 A * 12/1995 Bishop ..... B02C 17/161 241/171
5,518,191 A 5/1996 Bartsch et al.
5,566,896 A * 10/1996 Stehr ..... B02C 17/161 241/171
5,697,564 A * 12/1997 Ballardini ..... B02C 17/161 241/171
5,791,569 A 8/1998 Ishikawa
5,797,550 A * 8/1998 Woodall ..... B02C 17/16 241/171
5,934,579 A 8/1999 Hiersche et al.
5,984,213 A 11/1999 Woodall et al.
6,808,136 B2 * 10/2004 Sneeringer ..... B01F 7/00466 241/172
7,014,134 B2 3/2006 Heinzelmann et al.
7,073,738 B2 * 7/2006 Sneeringer ..... B01F 7/00466 241/172
7,374,116 B2 5/2008 Ishikawa et al.
7,588,205 B2 9/2009 Ishikawa et al.
8,002,213 B2 8/2011 Stehr
8,794,558 B2 8/2014 Pausch et al.
8,814,071 B2 * 8/2014 Jeker ..... B02C 17/161 241/21
9,675,978 B2 * 6/2017 Rubenstein ..... B02C 17/161
10,173,222 B2 * 1/2019 Simons ..... B02C 17/161
10,792,665 B2 * 10/2020 Simons ..... B02C 17/163
2005/0224612 A1 10/2005 Heinzelmann et al.
2009/0072060 A1 3/2009 Pausch
2010/0127108 A1 5/2010 Harbs
2011/0036935 A1 2/2011 Stehr
2011/0121115 A1 5/2011 Lang et al.
2011/0168814 A1 * 7/2011 Brook-Levinson ..... B02C 17/161 241/21
2011/0226878 A1 * 9/2011 Martin ..... B07B 1/06 241/25
2013/0233953 A1 * 9/2013 Enderle ..... B02C 17/16 241/38
2015/0102139 A1 * 4/2015 Nied ..... B02C 17/1835 241/12
2015/0174583 A1 * 6/2015 Nied ..... B02C 17/1835 241/30
2018/0104699 A1 * 4/2018 Simons ..... B02C 17/20

FOREIGN PATENT DOCUMENTS

DE 256460 A1 5/1988
DE 102007043670 A1 4/2009
EP 1259327 B1 11/2002
EP 1468739 A1 10/2004

OTHER PUBLICATIONS

International Search Report Application No. PCT/DE2014/000330 Completed: Oct. 2, 2014; dated Oct. 13, 2014 3 Pages.
U.S. Office Action U.S. Appl. No. 14/978,763 dated Mar. 11, 2019 8 Pages.

* cited by examiner

AGITATOR BALL MILL WITH AXIAL CHANNELS

FIELD OF THE INVENTION

The invention relates to an agitator ball mill with a grinding container, wherein an agitator shaft provided with grinding elements is disposed, as result of which a grinding chamber is formed between the grinding container and the agitator shaft, in which grinding chamber the grinding elements extend and in which at least one inlet channel and one outlet channel for grinding stock emerge and a dynamic separating device for auxiliary grinding bodies is provided, wherein the dynamic separating device is provided with recesses for the return of auxiliary grinding bodies. The invention also relates to a method for grinding with an agitator ball mill with the device according to the invention, wherein grinding stock is supplied via a supply opening, said grinding stock being conveyed via the grinding chamber in the direction of the dynamic separating device, wherein auxiliary grinding bodies contained in the grinding stock are transported in the radial direction back into the grinding chamber by means of the separating device.

BACKGROUND OF THE INVENTION

Agitator ball mills are used for the size-reduction and homogenisation of solid particles, wherein auxiliary grinding bodies are moved intensively by means of an agitator shaft. The solid particles are thereby size-reduced by impact, pressure, shearing and friction. In principle, agitator ball mills can be different with regard to a horizontal or vertical orientation of the grinding chamber. The activation of the auxiliary grinding bodies takes place by means of the agitator shaft, which can be provided with agitator elements such as for example rods or discs. The grinding chamber is usually filled up to seventy to ninety percent with auxiliary grinding bodies in the size range from 0.03-9 mm.

The product to be ground flows continuously in the grinding process from a product inlet axially through the grinding chamber to a product outlet. The separation of the auxiliary grinding bodies from the product flow then takes place in an outlet region by means of a separating system.

The throughput and the size of the grinding bodies are limited by the separating device in closed agitator ball mills. With the aid of the separating device, the auxiliary grinding bodies are intended to be reliably held back in the grinding container and, even in the presence of high throughput rates, must not lead to compression of the grinding bodies or to blockages. The separating devices can be constituted in a known manner as splitting systems, centrifugal systems or as external separating systems. Known splitting systems are for example sieve cartridges or split tubes, which can be disposed at different points of the grinding chamber.

Centrifugal systems are also known from the prior art as dynamic separating devices, wherein the auxiliary grinding bodies are accelerated radially, as a result of which the latter are transported back into the grinding container on account of the acting centrifugal force. Such dynamic separating devices can be constituted for example by a cage rotating around a sieve, the use whereof finds particular application in the case of high throughput rates or when use is made of extremely small grinding bodies.

An agitator ball mill is known for example from DE 102007043670 A1, wherein a part of the drive energy is transmitted to auxiliary grinding bodies by means of an agitator shaft connected to a drive, as result of which penetration of the auxiliary grinding bodies into the grinding stock outlet is prevented.

Another agitator ball mill known from the prior art with a grinding body separating system (DD 256460 A1) comprises a separating sieve, with the aid whereof the auxiliary grinding bodies are intended to be held in the grinding chamber. The grinding body separating system is constituted for this purpose by a rectangular, box-type sieve frame, a lower curved separating sieve with a rectangular shape and a grinding body sieve trap lying beneath the latter at a distance. The actual grinding body separation is brought about by the separating sieve constituted rectangular, which is fastened to the sieve frame by means of holding elements on two opposite sides, which is inserted with both sieves as a closed modular unit into the grinding container.

A further agitator ball mill provided with a dynamic separating system is disclosed in European patent application EP 1468739 A1, wherein the separating device is disposed in front of a stock outlet and is constituted by a separating element and a drive element driving the latter. The separating element comprises two circular discs disposed coaxial with the chamber axis, between which discs a plurality of conveying or wing elements are disposed, being distributed symmetrically about the centre-point of the discs and leading inwards from the edge of the disc, said conveying or wing elements generating a counter-pressure on the stock/grinding body mixture during operation of the agitator ball mill, so that the auxiliary grinding bodies are separated from the product and conveyed back into the interior as a result of the centrifugal force and the different specific density.

The separating devices known from the prior art for agitator ball mills are able to prevent auxiliary grinding bodies from passing into the product outlet, but it has been shown in practice that an increased concentration of auxiliary grinding bodies occurs in the region of the separating device. The actual grinding process does not however take place in this region, but in the grinding chamber in a region before the separating device. The low concentration of auxiliary grinding bodies in the region that is particularly effective for grinding causes a reduced grinding efficiency, which can lead to an unsatisfactory grinding result.

It would therefore be desirable to make available an agitator ball mill with a separating system which enables an improved distribution of the auxiliary grinding bodies in the grinding chamber. The desired uniform distribution of the auxiliary grinding bodies in the grinding chamber should be possible without design modifications, additions or conversions of the grinding chamber. The known devices of the aforementioned type, however, are not entirely suitable for a uniform auxiliary grinding body distribution.

SUMMARY OF THE INVENTION

The problem underlying the invention, therefore, is to provide a device of the type mentioned at the outset, which enables an improved distribution of the auxiliary grinding bodies in the grinding chamber.

According to the invention, this problem is solved by the fact that the agitator shaft is provided with at least one recess that extends the dynamic separating device, said recess extending in the axial direction into the grinding chamber.

The invention proceeds from the consideration that, for a uniform distribution of the auxiliary grinding bodies in the grinding chamber, the return of the auxiliary grinding bodies into the grinding chamber can take place through a suitable embodiment and coupling of the separating device and the agitator shaft. The return of the auxiliary grinding bodies should in particular be able to take place, as far as possible, without a costly conversion of the grinding container or through rerouting the auxiliary grinding bodies outside the grinding container.

This is achieved by the fact that the dynamic separating device is coupled with the agitator shaft in such a way that at least one recess of the separating device is extended axially, in such a way that the extended recess extends in the axial direction in a region of the agitator shaft into the grinding chamber. For this purpose, recesses are introduced into the agitator shaft, said recesses being connected to the recesses in the separating device and extending the latter. During operation of the mill, part of the auxiliary grinding bodies can thus be conveyed through the recess in the agitator shaft back into the grinding chamber.

The region of the recesses of the separating device is preferably smaller in the axial direction than the region with the extended recess. As a result of a separating region thus shortened or a lengthened region outside this separating region, the auxiliary grinding bodies are conveyed farther in the axial direction into the grinding chamber, so that the dwell time of the auxiliary grinding bodies in the grinding chamber is effectively increased.

The extended recess preferably runs axis-parallel with the rotary axis of the agitator shaft. It is particularly advantageous here that the production cost for introducing such a recess into the agitator shaft is comparatively low.

It has proved to be advantageous if the extended recess runs at least partially in the axial direction helically or in the form of a helical line around the rotary axis of the agitator shaft. The flow rate, for example, and therefore also an exit point or re-entry point of the auxiliary grinding bodies into the grinding chamber can thus be favourably influenced. If, for example, the helical recess runs against the direction of rotation of the agitator shaft, the flow rate in the axial direction towards the product inlet is increased, as result of which the re-entry point of the auxiliary grinding bodies can be displaced into a front region of the grinding chamber, close to the product inlet.

In a particularly advantageous embodiment, the extended recess essentially extends over the entire length of the agitator shaft. The effect of this is that the auxiliary grinding bodies can also be distributed over the entire length of the agitator shaft in the grinding chamber.

It is also regarded as advantageous if the extended recess is constituted as a flow channel. Through a suitably selected cross-section of the channel for example, the distribution of the auxiliary grinding bodies can thus be influenced in an advantageous way.

The flow channel can be introduced into the agitator shaft at least in sections as a groove or as an axial bore. It is for example also conceivable that the flow channel is introduced into the agitator shaft as a bore in an axial region close to the separating device and is constituted as a groove in a section close to the product inlet. The auxiliary grinding bodies are thus conveyed in the axial direction through a flow channel and only exit again close to the product inlet into the grinding chamber.

According to a preferred development, the number of flow channels corresponds to the number of the recesses of the separating device. The uniform distribution of the auxiliary grinding bodies is further improved by the plurality of flow channels distributed over the circumference of the agitator shaft. In this regard, it is also viewed as advantageous if the flow channels run parallel with one another.

According to the invention, the grinding process in the grinding chamber is improved by the fact that the auxiliary grinding bodies can additionally flow into the grinding chamber through a section of the agitator shaft coupled with the separating device. Without the inventive coupling with the separating device, experience shows that an increased concentration of the auxiliary grinding bodies in the vicinity of the separating device occurs during the grinding process, the effect of which is that the concentration of auxiliary grinding bodies falls in the region of the agitator shaft. The aim, however, is to achieve a distribution of the auxiliary grinding bodies that is as uniform as possible in the grinding chamber so that the grinding process can proceed effectively.

During the operation of the agitator ball mill, a material to the ground, for example in liquid form, is conveyed continuously via an inlet channel into the interior of the grinding chamber and is conveyed in the latter together with the auxiliary grinding bodies to the product outlet. The auxiliary grinding bodies are separated from the grinding stock in the region of the product outlet by means of the separating device and the grinding stock is conveyed out of the grinding container via the outlet channel. In contrast with the known methods, the auxiliary grinding bodies, proceeding from the separating device, flow along the agitator shaft back into the grinding chamber due to the fact that the resistance to the auxiliary grinding bodies, caused by the continuously conveyed grinding stock, is reduced on account of the inventive embodiment of the separating device and the agitator shaft.

The exit point or exit region of the auxiliary grinding bodies is preferably adjusted by adjusting and coordinating the speed of the agitator shaft, the cross-sectional shape of the return channels and/or the orientation of the extending recess in the agitator shaft. The adjustment and coordination can take place manually or in an automated manner by means of a control loop. Since the exit point is also dependent, amongst other things, on the throughput rate and therefore the flow rate, which can change from grinding process to grinding process depending on the given task and requirements on the grinding outcome, said exit point should be adaptable. For example, it has been shown that the exit point with a comparatively high throughput rate can be displaced in a disadvantageous way in the direction of the separating device. By a suitable choice of the speed of the agitator shaft and/or the embodiment of the return channels, the displacement of the exit point can be counteracted.

For the method according to the invention, the agitator shaft comprises at least one recess extending in the axial direction, which is assigned to a dynamic separating device. The recess is preferably constituted as a flow channel and suitably leads auxiliary grinding bodies back into the grinding chamber. In particular, the agitator shaft comprises on the separating-device side an end portion with which a connection of the flow channel with at least one recess of the separating device can be produced.

The dynamic separating device can be driven both by the agitator shaft as well as by means of a separate device. The separating device is constituted such that the mixture constituted by the auxiliary grinding bodies and the ground and/or dispersed stock can flow via the recesses of the separating device to the product outlet. During flowing into the recess, a part of the rotation energy is transmitted to the auxiliary grinding bodies, after which the grinding bodies used for the grinding are separated from the grinding stock on account of the radially acting centrifugal force and the different density and are conveyed back into the interior of the grinding chamber. The grinding stock itself passes through the separating device and leaves the grinding chamber via the outlet channel.

As a result of the rotation of the dynamic separating device, the grinding stock, as it flows through the separating device against the centrifugal force, has to overcome a relative pressure, said pressure being generated by a feed pump which is connected to the inlet channel of the agitator ball mill. On the other hand, the auxiliary grinding bodies have to be transported back in the direction of the grinding chamber against the flow generated by the feed pump, which in the case of the known agitator ball mills usually leads to an accumulation of the auxiliary grinding bodies in the region of the separating device. As a result of the inventive recesses in the agitator shaft running axially into the grinding chamber, the auxiliary grinding bodies can take an evasive route via these recesses. The flow of grinding stock on the one hand and of the auxiliary grinding bodies on the other hand acting radially from both sides leads to a flow of the auxiliary grinding bodies in the extended recesses back into the grinding chamber, preferably into a region of the agitator shaft that is particularly effective for grinding.

The extended recess in the agitator shaft is preferably introduced into the agitator shaft as a flow channel in the form of a groove and/or a bore. This thus makes it possible for the auxiliary grinding bodies to flow in a specific direction and for the auxiliary grinding bodies not to exit out of the agitator shaft until they are at a specific point, for example by a suitable combination of groove and bore.

In a further preferred embodiment, at least one radially running longitudinal wall of the flow channel is angled, in such a way that, in addition to the centrifugal force, a further radial force component created by the angled channel wall acts on the auxiliary grinding bodies in the flow channel. An accumulation of the auxiliary grinding bodies, for example, can thus be prevented by the fact that the auxiliary grinding bodies leave the flow channel again relatively quickly. Due to the increased radial acceleration of the auxiliary grinding bodies resulting therefrom, the latter are conveyed farther into the grinding chamber in the radial direction, which contributes towards an improved distribution of the auxiliary grinding bodies in the cross-section of the grinding chamber. It is however also conceivable for at least one channel wall to run helically in the axial direction in order for example to allow the auxiliary grinding bodies not to exit again until they are at a specific region of the grinding chamber or to do so in an intensified manner.

In an alternative or additional advantageous development, the grinding elements of the agitator shaft are constituted as grinding discs and comprise at least one opening close to the centre, said opening being introduced into the grinding disc as a through-going recess. Distance bushings are disposed between the grinding discs. The grinding discs are axially braced with the distance bushings and form the agitator which is followed by the dynamic separating device. The return channel runs axially through the openings in the grinding discs.

The distance bushings preferably have a polygonal cross-section, in particular a square cross-section. The distance bushings can however also have another cross-section. It should however be noted that the cross-section of the distance bushing is not circular, because otherwise the desired pumping effect in the radial direction is not achieved.

The opening in the grinding discs is introduced close to the centre in such a way that auxiliary grinding bodies flowing through the opening close to the centre are picked up by the distance bushings, accelerated and transported radially outwards. The distance bushings are preferably constituted such that their edges sweep at least partially, particularly preferably completely over the opening area when the agitator shaft is rotating.

In addition, the grinding discs can advantageously comprise radial recesses. The latter serve primarily to activate the auxiliary grinding bodies, but can also enable an additional return flow of the auxiliary grinding bodies in accordance with the invention.

The advantages achieved with the invention lie in particular in the fact that the auxiliary grinding bodies in the region of the separating device can take an evasive route through the return channels, as a result of which a local accumulation of the auxiliary grinding bodies is prevented. The uniform distribution of the auxiliary grinding bodies that is sought for an effective grinding process can be achieved by the recesses running axially into the grinding chamber. In addition, an adaptation of the distribution of the auxiliary grinding bodies to the given grinding task can be made by the described design adaptations of the agitator shaft and/or of the grinding parameters such as speed and through-flow rate. A further advantage results from the fact that the advantageous effect is essentially based on the special embodiment of the agitator shaft. An agitator ball mill can thus also be modified with corresponding design requirements and/or suitable adapter components.

BRIEF DESCRIPTION OF THE DRAWINGS

Embodiments of the present invention are described by way of example by reference to the appended drawings. In the figures.

DETAILED DESCRIPTION OF THE INVENTION

Figure 1A:
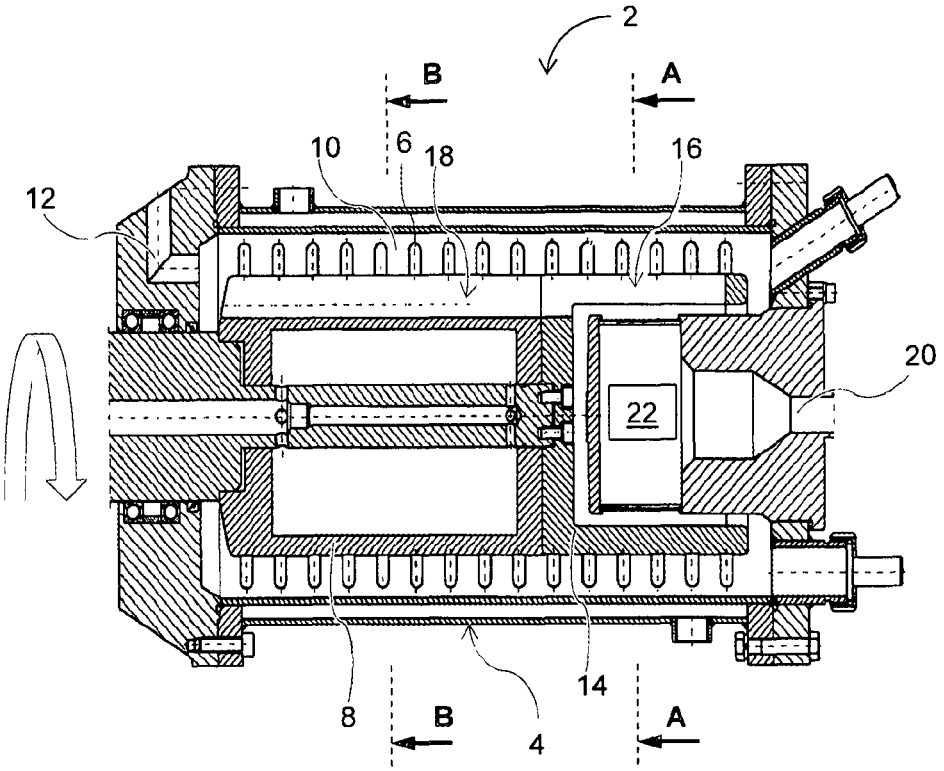
FIG. 1*a* shows diagrammatically in a longitudinal cross-section an agitator ball mill with a dynamic separating device which is coupled with the agitator shaft, and which comprises return channels introduced as a groove into the agitator shaft, said return channels axially extending recesses in the separating device.

Agitator ball mill 2 according to FIG. 1 comprises a grinding container 4, in which an agitator shaft 8 provided with grinding elements 6 is disposed, as a result of which a grinding chamber 10 is formed between grinding container 4 and agitator shaft 8, in which grinding chamber grinding elements 6 extend, in which at least one inlet channel 12 for grinding stock emerges and a dynamic separating device 14 for auxiliary grinding bodies is provided, wherein separating device 14 is provided with recesses 16 for the return of auxiliary grinding bodies and agitator shaft 8 is provided with groove-shaped recesses 18 extending separating device 14, said recesses extending into grinding chamber 10 in the axial direction against the product flow towards the inlet region.

A static separating device constituted as a sieve 22 is disposed upstream of a product outlet channel 20. Groove-shaped recesses 18 in agitator shaft 8 run axis-parallel with the rotational axis of agitator shaft 8 and form return channels 18 for the auxiliary grinding bodies. Return channels 18 and recesses 16 in separating device 14 merge into one another, so that the auxiliary grinding bodies can take an evasive route via return channels 18 in the direction of the product inlet during operation of mill 2, arrive back in the grinding chamber and thus become distributed.

Agitator ball mill 2 is designed in such a way that the stock to the ground is conveyed continuously into grinding container 4 via inlet channel 12 by means of a pump not represented here and flows in grinding chamber 10 together with auxiliary grinding bodies axially in the direction of outlet channel 20 and is thereby ground. In the region of separating device 14, the grinding stock flows with the grinding bodies through recess 16 in separating device 14. The grinding stock leaves grinding container 4 via outlet channel 20 and the auxiliary grinding bodies are moved radially outwards on account of the centrifugal forces acting on the auxiliary grinding bodies due to rotating separating device 14. The continuously conveyed grinding stock/auxiliary grinding body mixture, however, flows from outside coming from grinding chamber 10 into recess 16 of separating device 14, for which reason the return flow of the auxiliary grinding bodies is hindered. As a result of this, the auxiliary grinding bodies flow into return channel 18 in agitator shaft 8 and are then further accelerated by likewise rotating agitator shaft 8 and conveyed back into grinding chamber 10.

Figure 1B:
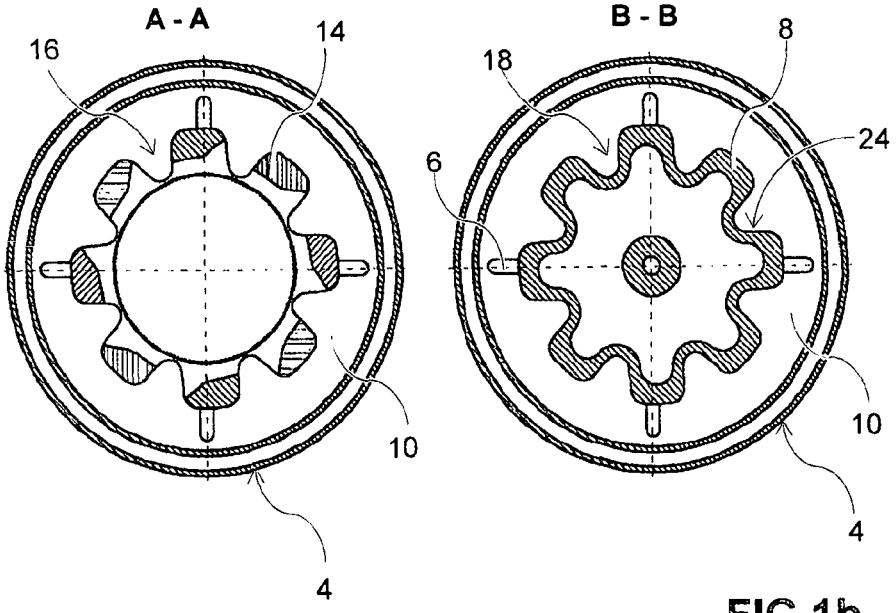
FIG. 1*b* shows diagrammatically the agitator ball mill from FIG. 1*a* in cross-section in the region of the separating device and in the region of the agitator shaft.

FIG. 1*b* shows cross-sections of agitator ball mill 2 from FIG. 1*a* on the one hand in the region of separating device 14 as cross-section A-A and on the other hand in the region of agitator shaft 8 as cross-section B-B. As can be seen from the representation, separating device 14 forms a kind of cage, through recesses 16 whereof the grinding stock/auxiliary grinding body mixture can flow and is thus accelerated during operation of mill 2. The cross-sectional shape of recesses 16 corresponds to the cross-sectional shape of return channels 18 in agitator shaft 8, which have a V-shape. As a result of the angled radially running longitudinal walls 24 of channels 18 thus formed, there acts on the auxiliary grinding bodies, apart from the centrifugal force, a further radially inwardly acting force, so that the auxiliary grinding bodies are conveyed intensively into grinding chamber 10.

Figure 2A:
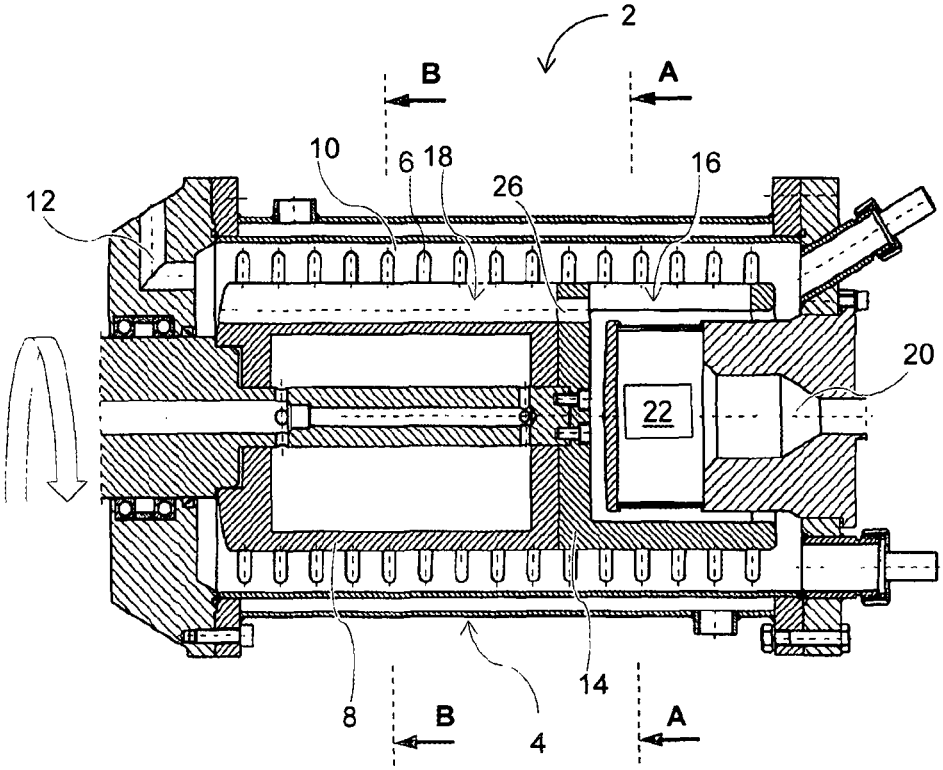
FIG. 2*a* shows diagrammatically in a longitudinal cross-section essentially the agitator ball mill from FIG. 1*a* with a dynamic separating device which is coupled with the agitator shaft, and which comprises return channels introduced as a groove into the agitator shaft, said return channels axially extending recesses in the separating device, wherein the recess in the separating device is connected via a bore to the return channel.

FIG. 2*a* represents an agitator ball mill 2, wherein recesses 16 in the separating device are connected via an axially introduced bore 26 to return channels 18 in agitator ball mill 2. It is also conceivable for one or more return channels 18 to be constituted as a bore in a first section of agitator shaft 8. The effect of this is that the auxiliary grinding bodies flowing in channel 18 do not exit until they are in a region close to the product inlet and are conveyed into grinding chamber 10. In order to achieve the selective exit into grinding chamber 10, use can be made, instead of a bore 26, of any other kind of recess that is suitable for conveying the auxiliary grinding bodies to a region or section with an open recess 18.

Figure 2B:
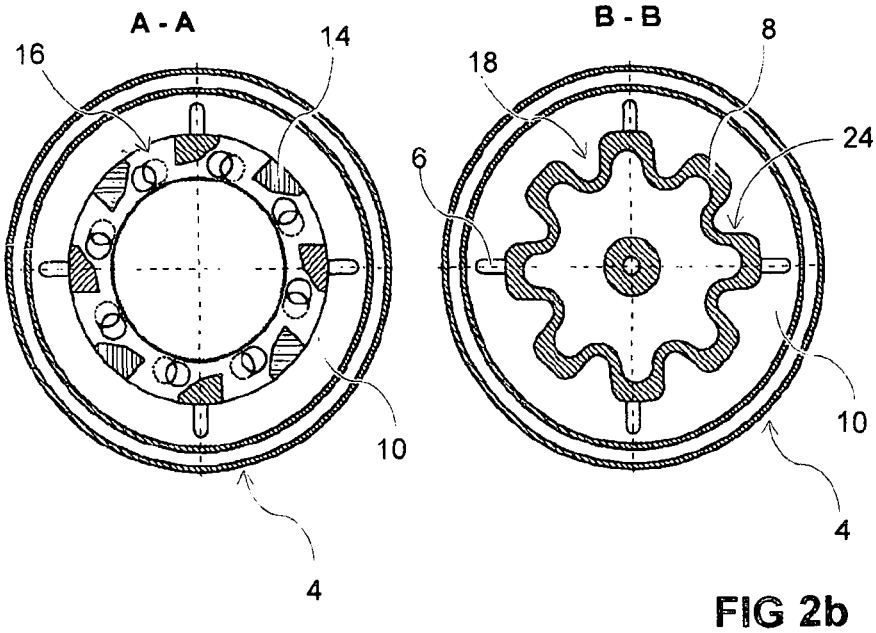
FIG. 2*b* shows diagrammatically the agitator ball mill from FIG. 2*a* in a transverse cross-section in the region of the separating device and in the region of the agitator shaft.

FIG. 2*b* shows cross-sections of agitator ball mill 2 from FIG. 2*a* on the one hand in the region of separating device 14 as cross-section A-A and on the other hand in the region of agitator shaft 8 as cross-section B-B. Bore 26, as a connection between recess 16 of the separating device and return channel 18, is introduced at an angle as viewed in the axial direction. This section of separating device 14 thus additionally acts as a pump for the auxiliary grinding bodies, which as a result of this pumping effect are sucked out of the region of separating device 14 in order that the auxiliary grinding bodies are conveyed into the grinding chamber in a region of agitator shaft 8.

Figure 3A:
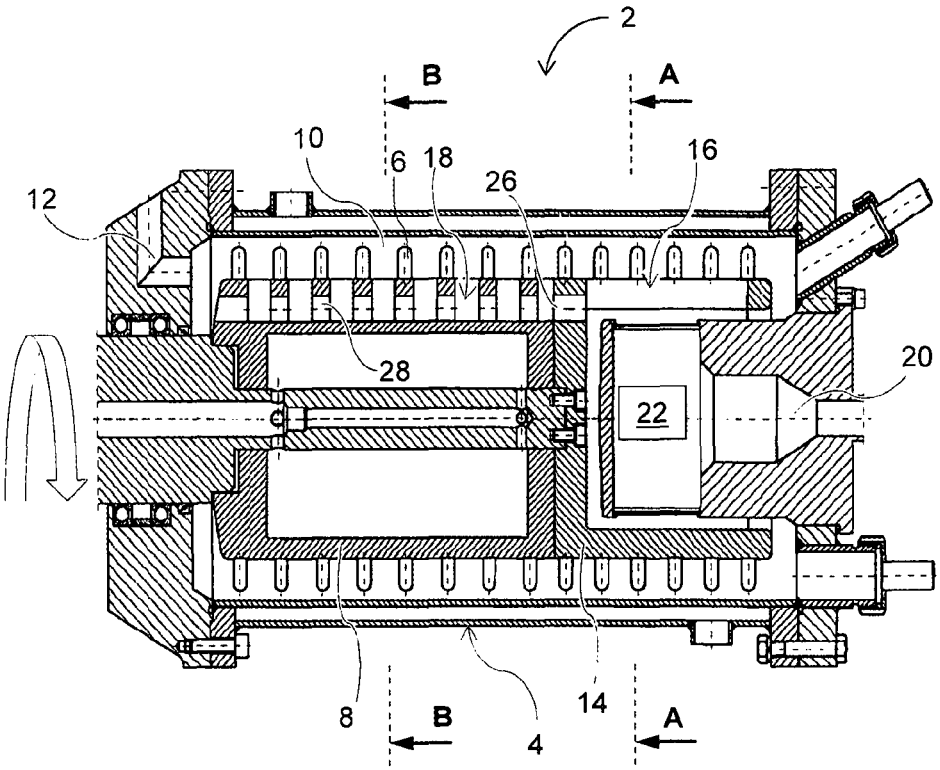
FIG. 3*a* shows diagrammatically in a longitudinal cross-section an agitator ball mill with a dynamic separating device which is coupled with the agitator shaft, and which comprises return channels introduced as a groove and bore into the agitator shaft, said return channels axially extending the recesses in the separating device.

An agitator ball mill 2 with a separating device 14 as represented in FIG. 2*a* is shown in FIG. 3*a*. Agitator shaft 8 comprises return channels 18 through axially running bores 28 in agitator shaft 8, said return channels being interrupted in sections and, as in the case out a return channel 18 introduced as a groove, are open towards grinding chamber 10. Bores 28 in the agitator shaft are introduced at an angle as viewed in the axial direction, like bores 26 of separating device 14, and act as a pump. The auxiliary grinding bodies can take an evasive route into the grinding chamber in the open sections of return channels 18.

Figure 3B:
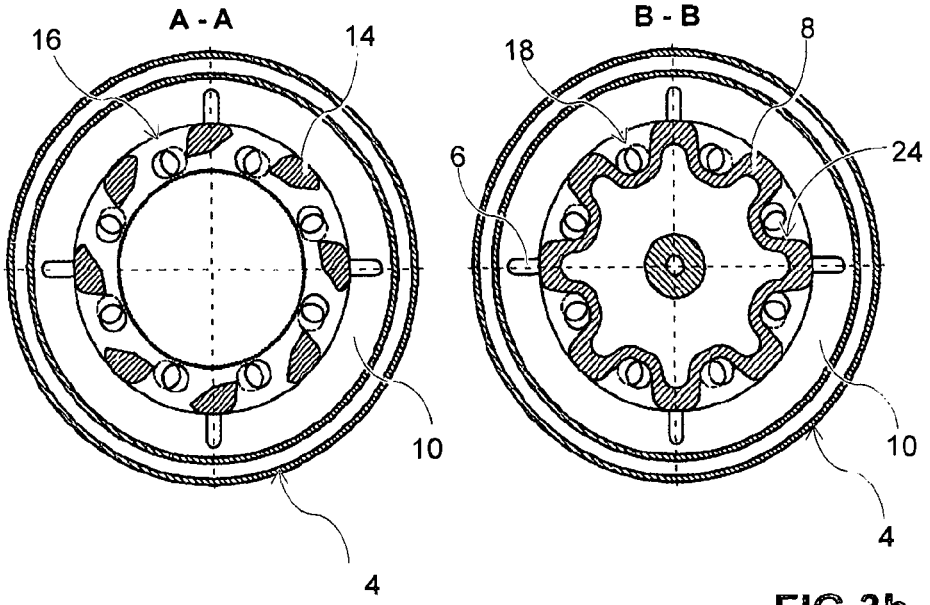
FIG. 3*b* shows diagrammatically the agitator ball mill from FIG. 3*a* in a transverse cross-section in the region of the separating device and in the region of the agitator shaft.

FIG. 3*b* shows cross-sections of agitator ball mill 2 from FIG. 3*a* on the one hand in the region of separating device 14 as cross-section A-A and on the other hand in the region of agitator shaft 8 as cross-section B-B.

Figure 4A:
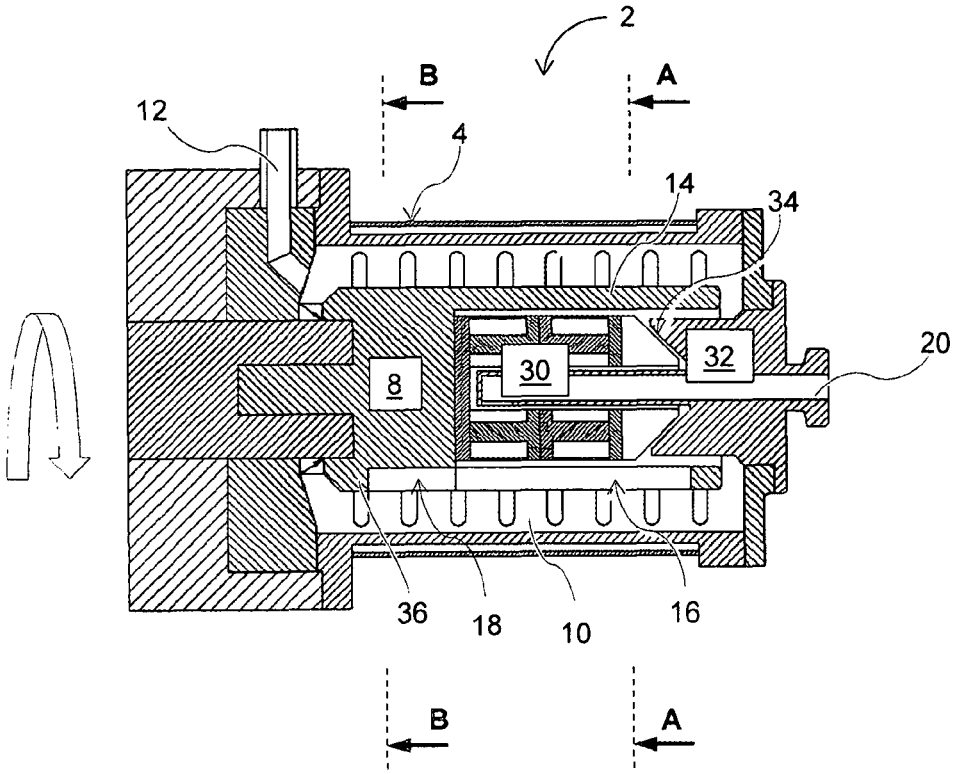
FIG. 4*a* shows diagrammatically in a longitudinal cross-section essentially the agitator ball mill from FIG. 1*a* with a dynamic separating device which is coupled with the agitator shaft, and which comprises return channels introduced as a groove into the agitator shaft, said return channels axially extending the recesses in the separating device, and an additional dynamic element.

FIG. 4*a* shows essentially agitator ball mill 2 from FIG. 1*a* with a dynamic separating device 14 which is coupled with agitator shaft 8, and which comprises return channels 18 introduced as a groove into agitator shaft 8, said return channels axially extending recesses 16 of separating device 14, and an additional dynamic element 30, which is provided with radially running channels or wings. Outlet-side end section 32 of mill 2 and adjoining additional dynamic element 30 run conically towards one another, as a result of which a gap 34 is formed, which generates a flow in the radial direction towards dynamic separating device 14. In contrast with agitator ball mill 2 shown in FIG. 1*a*, return channel 18, on the product-inlet side as viewed in the axial direction, is closed by a wall 36. By means of wall 36, disadvantageous flowing of the material to be ground into return channel 18 from the product inlet side can be counteracted.

Figure 4B:
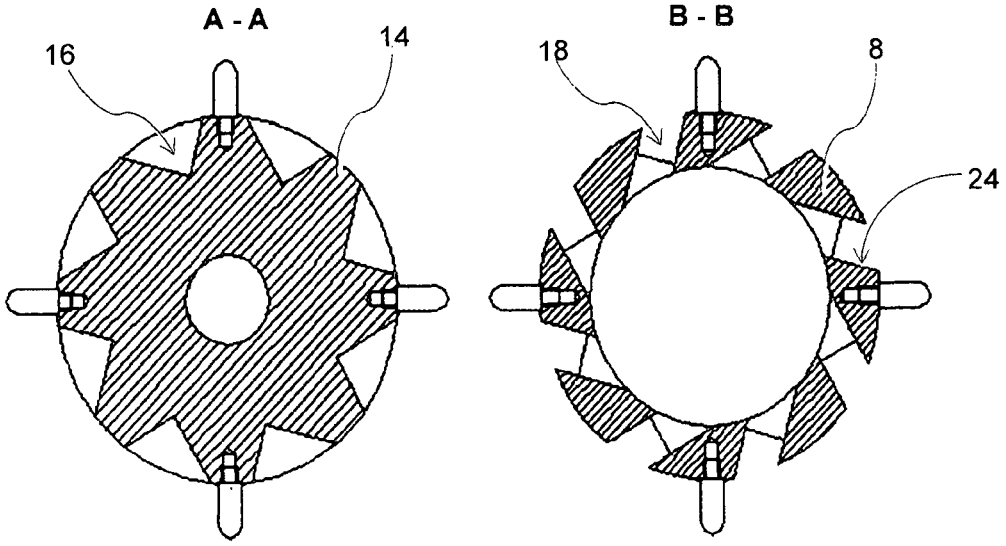
FIG. 4*b* shows diagrammatically the agitator ball mill from FIG. 4*a* in a transverse cross-section in the region of the separating device and in the region of the agitator shaft.

FIG. 4*b* shows cross-sections of agitator ball mill 2 from FIG. 4*a* on the one hand in the region of separating device 14 as cross-section A-A and on the other hand in the region of agitator shaft 8 as cross-section B-B. Recesses 16 in separating device 14 are introduced at an angle as viewed in the radial direction, as a result of which an additional pumping effect is generated radially outwards. With a relatively high throughput rate, a sufficiently strong counterflow can thus be generated in order to convey the auxiliary grinding bodies radially outwards, in order that the latter can pass via return channel 18 back into grinding chamber 10.

Figure 5:
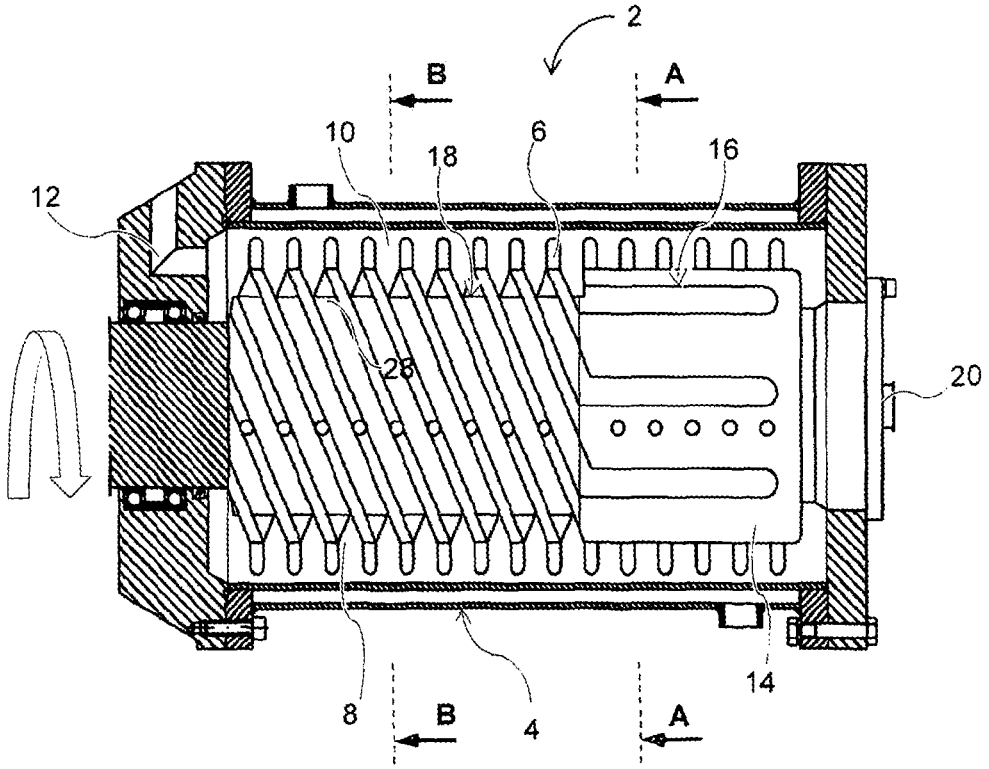
FIG. 5 shows diagrammatically in a longitudinal cross-section an agitator ball mill with a dynamic separating device which is coupled with the agitator shaft, and which comprises return channels introduced as a groove into the agitator shaft, said return channels axially extending the recesses in the separating device, wherein the return channels run in a helical manner around the agitator shaft.

Agitator ball mill 2 with an agitator shaft 8 with return channels 18 running in a helical manner in the axial direction, said return channels being introduced as a groove into agitator shaft 8, is represented in FIG. 5. In this embodiment, a flow in the axial direction towards the product inlet is also generated as a result of the helical course of channels 18. Recesses 16 of separating device 14, on the other hand, are introduced axis-parallel with the rotational axis of agitator shaft 8.

Figure 6:
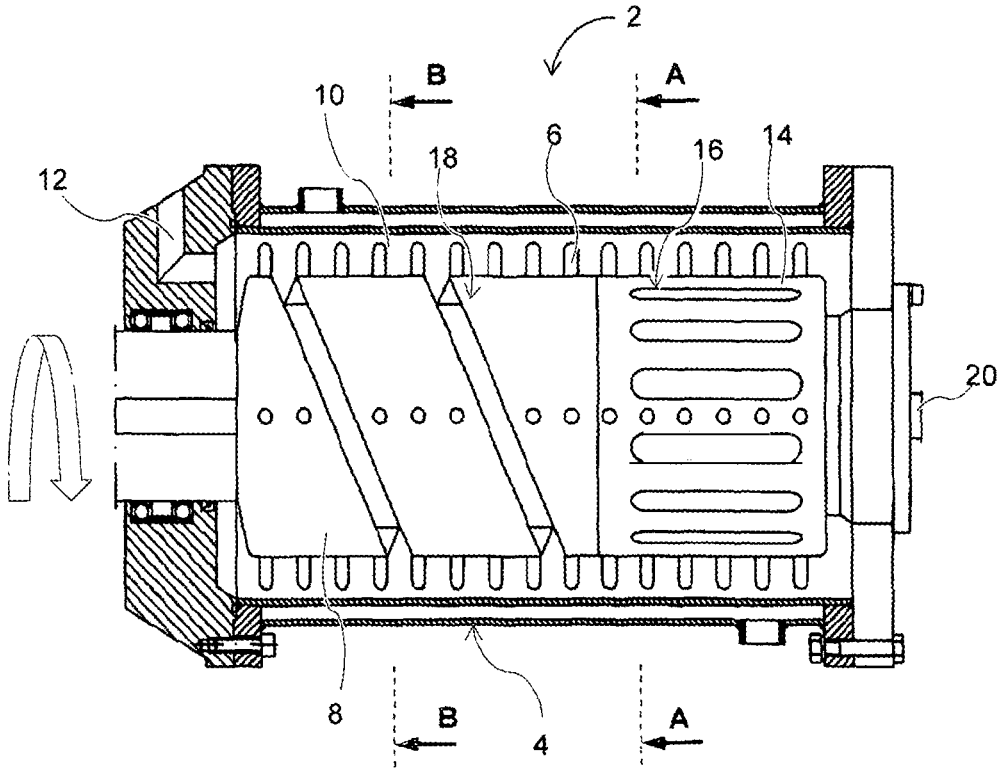
FIG. 6 shows diagrammatically in a longitudinal cross-section an agitator ball mill with a dynamic separating device which is coupled with the agitator shaft, and which comprises a return channel introduced as a groove into the agitator shaft, said return channels axially extending the recesses in the separating device, wherein the return channel runs in a helical manner around the agitator shaft.

FIG. 6 represents an agitator ball mill 2 as already shown in FIG. 5. In this embodiment, however, agitator shaft 8 comprises only one return channel 18, which is also coupled with only one recess 16 of separating device 14. It is however also conceivable to introduce between recesses 6, 18 a recess running in the circumference into separating device 14 or into agitator shaft 8. The auxiliary grinding bodies could thus be conveyed from all recesses 16 in separating device 14 via the connecting recess into return channel 18.

Figure 7:
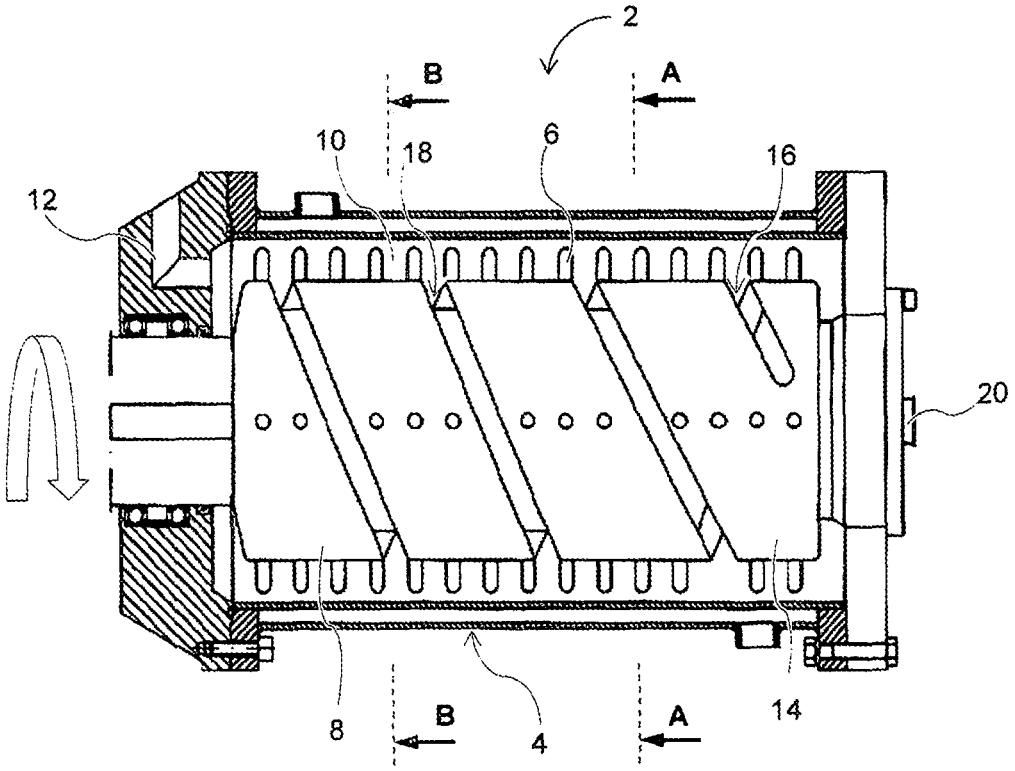
FIG. 7 shows diagrammatically in a longitudinal cross-section an agitator ball mill with a dynamic separating device which is coupled with the agitator shaft, and which comprises a return channel introduced as a groove into the agitator shaft, said return channel axially extending the recesses in the separating device, wherein the return channel and the recess in the separating device run in a helical manner around the agitator shaft.
Figure 8A:
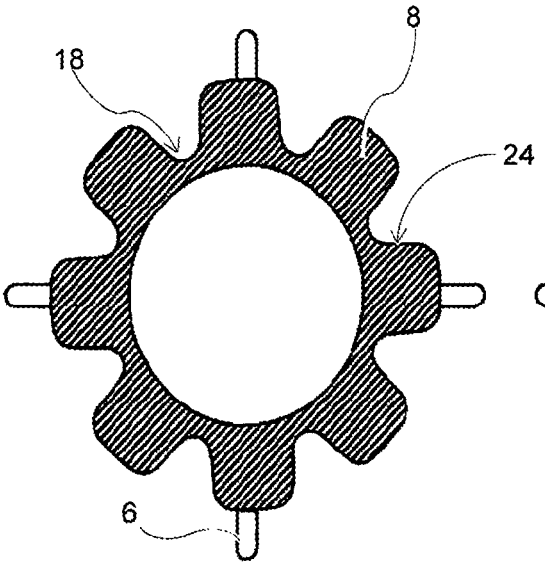
FIGS. 8*a*-8*d* show diagrammatically in a transverse cross-section an agitator shaft with embodiments of the extended recess of the agitator shaft shown by way of example and FIGS. 9*a*-9*f* show diagrammatically in a transverse cross-section an agitator shaft, wherein the grinding elements are constituted as grinding discs with an opening close to the centre and distance bushings are disposed between the grinding discs.
Figure 8B:
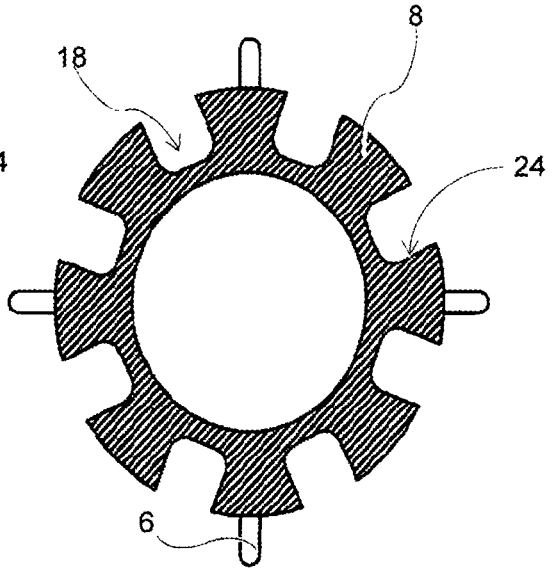
Figure 8C:
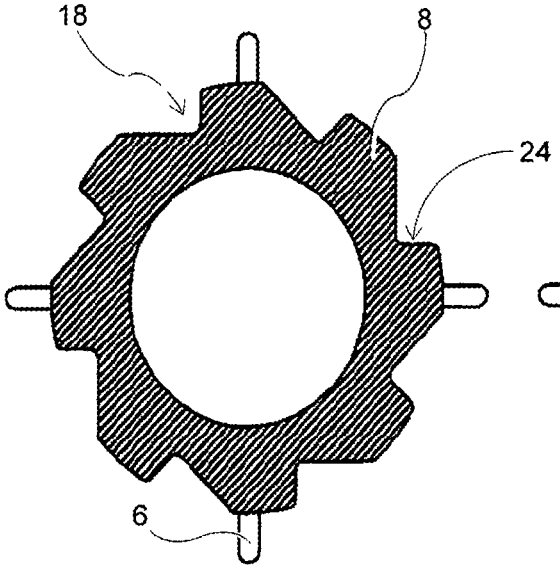
Figure 8D:
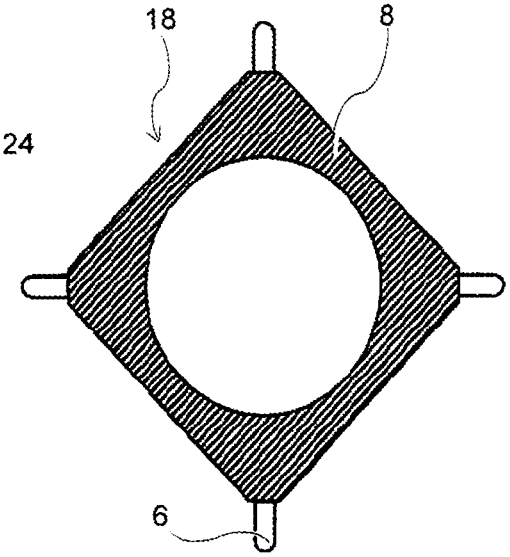

Return channel 18 could however also be introduced in a helical form continued over the separating device 14. Such an embodiment is represented in FIG. 7. Separating device 14 comprises only one recess 16, which transforms into return channel 18.

FIG. 8 show in cross-section by way of example various embodiments of agitator shaft 8. In particular, reference is made to FIG. 8*d*, wherein agitator shaft 8 comprises recesses 18, but the latter are not constituted as channels 18 as in the figures described above. A kind of return channel 18 is formed by the rotation of agitator shaft 8 during operation of mill 2. On account of a continuous displacement of the grinding stock/auxiliary grinding body mixture, a similarly constituted grinding chamber 10 arises as with an agitator shaft 8 with a return channel 18, wherein the auxiliary grinding bodies can flow back beneath grinding chamber 10.

Grinding discs 38 as grinding elements with at least one opening 40 close to the centre are represented in FIG. 9. Distance bushings 42 are disposed between grinding discs 38. Grinding discs 38 and distance bushings 42 are braced axially and form, together with an inventive dynamic separating device not represented here, an agitator shaft.

Figure 9A:
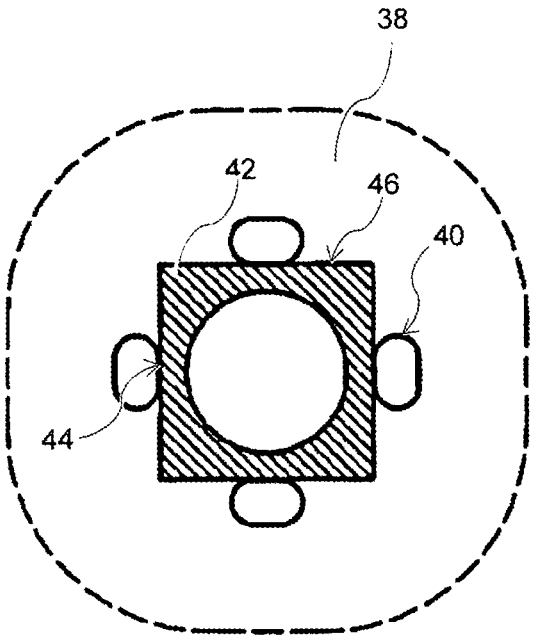
Figure 9B:
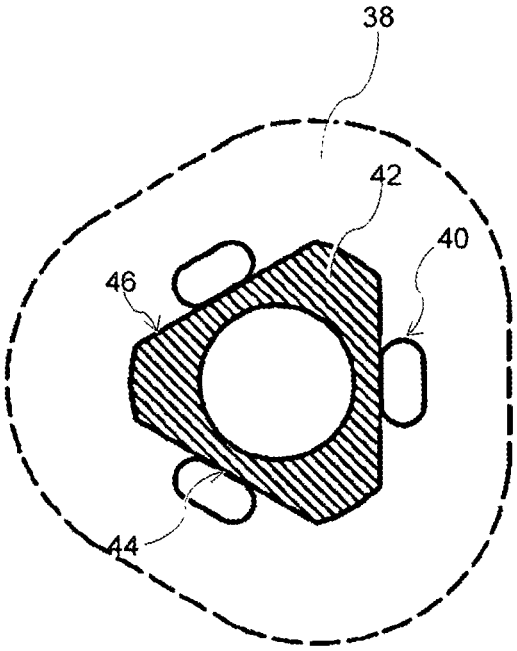
Figure 9C:
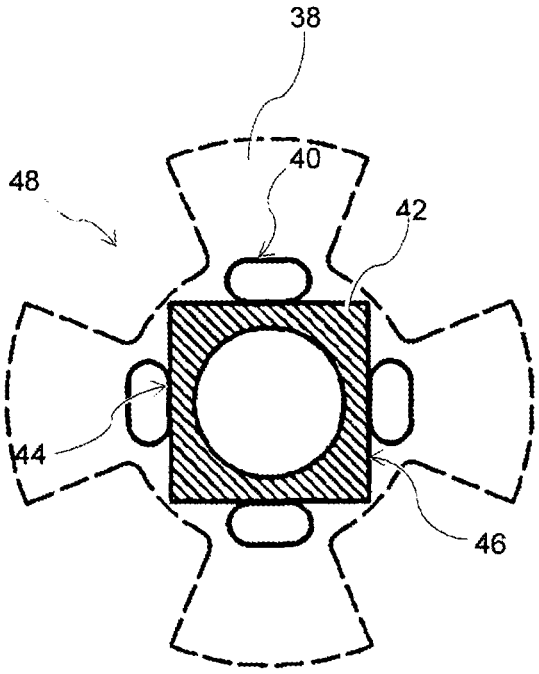
Figure 9D:
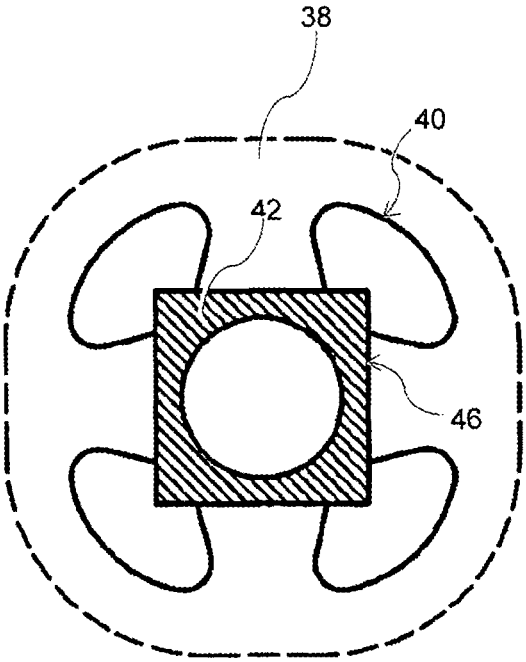

Each grinding disc 38 in FIGS. 9*a* to 9*d* is provided with a total of four openings 40, through which auxiliary grinding bodies can flow back. The shapes of the grinding discs are illustrated by the dashed line and distance bushings 42 have a polygonal cross-section. Openings 40 are introduced into grinding disc 38 in such a way that a lower opening wall 44, as represented in FIGS. 9*a*, 9*b*, 9*c*, terminates flush with a face 46 of distance bushing 42. Distance bushings 42 are constituted such that their edges completely sweep over openings 40 during rotation of agitator shaft 8. In FIG. 9*d*, on the other hand, distance bushing 42 projects, as viewed in the axial direction, into opening 40, so that opening 40 is swept over only partially during rotation of agitator shaft 8.

It has been shown in practice that, as a result of the arrangement of openings 40 close to the centre, the auxiliary grinding bodies are transported particularly effectively back into the grinding chamber.

A grinding disc 38 with a distance bushing 42 with a square cross-section is represented in FIGS. 9*a*, 9*c*, 9*d*, wherein grinding disc 38 in FIG. 9*c* additionally comprises a total of 4 radial recesses 48. FIG. 9*b* shows a grinding disc 38 with a triangular shape and flattened or rounded-of corners, wherein distance bushing 42 has in cross-section a shape corresponding to grinding disc 38.

Figure 9E:
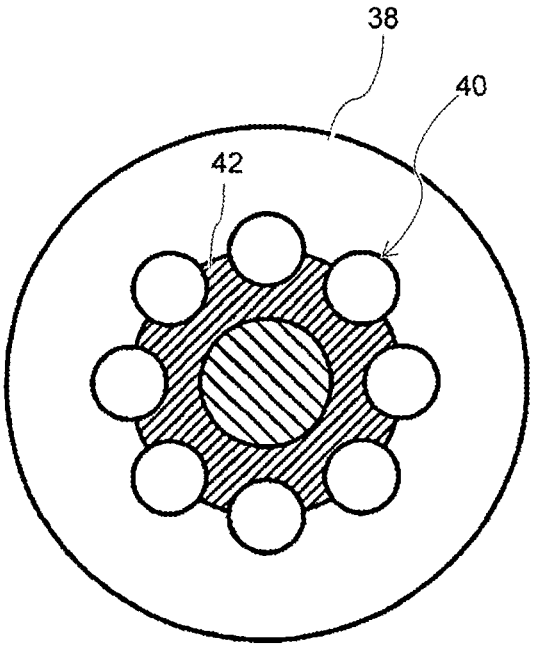
Figure 9F:
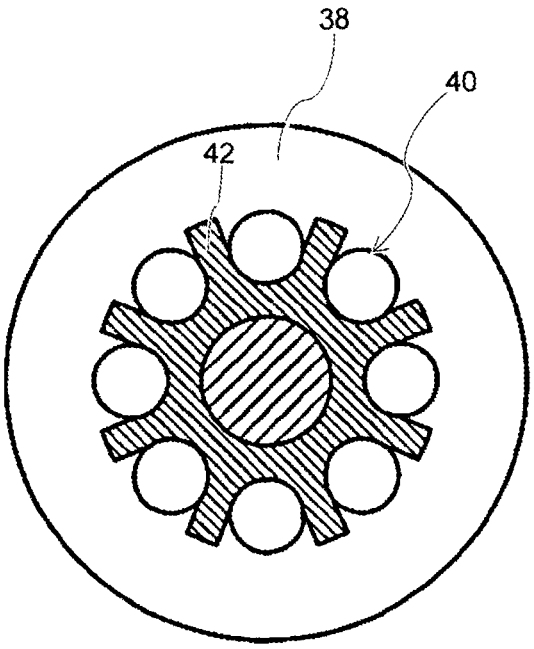

FIGS. 9*e* and 9*f* show by way of example further inventive embodiments and arrangements of a grinding disc 38 with an opening 40 close to the centre and a distance bushing 42. The variants represented in FIG. 9 are not exhaustive, in particular a combination of different grinding discs 38 and distance bushings 42 is conceivable, as long as an inventive return flow of the auxiliary grinding bodies is ensured.

Agitator ball mill 2 is specifically aimed at an effective distribution of the auxiliary grinding bodies in grinding chamber 10. Due to the fact that the auxiliary grinding bodies are conveyed in the axial direction along agitator shaft 8 from separating device 14 back into grinding chamber 10, an increased concentration of auxiliary grinding bodies in the region of separating device 14 is prevented.

Furthermore, unground product that flows close to the centre along agitator shaft 8 from the inlet region of agitator ball mill 2 in the axial direction towards separating device 14 is also conveyed in the radial direction back into grinding chamber 10, into an outer more effective grinding region. In the case of an agitator ball mill 2 with grinding discs 38, this effect becomes particularly marked in the case of grinding discs 38 with a radial recess 48, since unground product can flow back close to the centre in the axial direction in particular through recesses 48 in grinding disc 38. The risk of unground product thus passing into outlet channel 20 is minimised by the pumping effect of distance bushings 42.

What is claimed is:

1. An assembly for an agitator ball mill, comprising:

an agitator shaft including:

a first grinding disc including a first opening proximate a center of the first grinding disc, the first opening extending through the first grinding disc in an axial direction of the first grinding disc; and a second grinding disc including a second opening proximate a center of the second grinding disc, the second opening extending through the second grinding disc in an axial direction of the second grinding disc; and a distance bushing disposed between the first grinding disc and the second grinding disc of the agitator shaft, the distance bushing including an edge that sweeps over at least a portion of the first opening of the first grinding disc during rotation of the first grinding disc about an axis of the agitator shaft.

2. The assembly of claim 1, wherein the edge of the distance bushing sweeps over an entirety of the first opening during rotation of the agitator shaft.

3. The assembly of claim 1, wherein the edge of the distance bushing sweeps over at least a portion of the second opening of the second grinding disc during rotation of the agitator shaft.

4. The assembly of claim 3, wherein the edge of the distance bushing sweeps over an entirety of the second opening during rotation of the agitator shaft.

5. The assembly of claim 1, wherein the first grinding disc includes an opening wall at least partially defining the first opening; and wherein in at least one rotational position of the first grinding disc relative to the distance bushing, the opening wall terminates flush with a face of the distance bushing.

6. The assembly of claim 1, wherein the distance bushing has a polygonal cross-sectional shape in a plane perpendicular to the axis of the agitator shaft.

7. The assembly of claim 6, wherein the distance bushing has a square cross-sectional shape in the plane perpendicular to the axis of the agitator shaft.

8. The assembly of claim 1, wherein the first grinding disc includes a radial recess and the second grinding disc includes a radial recess.

9. An agitator ball mill, comprising:

a grinding container;

an inlet channel for inputting grinding stock into the grinding chamber; and an assembly including:

an agitator shaft including:

a first grinding disc including a first opening proximate a center of the first grinding disc, the first opening extending through the first grinding disc in an axial direction of the first grinding disc; and a second grinding disc including a second opening proximate a center of the second grinding disc, the second opening extending through the second grinding disc in an axial direction of the second grinding disc; and a distance bushing disposed between the first grinding disc and the second grinding disc of the agitator shaft, the distance bushing including an edge that sweeps over at least a portion of the first opening of the first grinding disc during rotation of the first grinding disc about an axis of the agitator shaft; and a grinding chamber formed between the grinding container and the agitator shaft.

10. The agitator ball mill of claim 9, wherein the edge of the distance bushing sweeps over an entirety of the first opening during rotation of the agitator shaft.

11. The agitator ball mill of claim 9, wherein the edge of the distance bushing sweeps over at least a portion of the second opening of the second grinding disc during rotation of the agitator shaft.

12. The agitator ball mill of claim 11, wherein the edge of the distance bushing sweeps over an entirety of the second opening during rotation of the agitator shaft.

13. The agitator ball mill of claim 9, wherein the first grinding disc includes an opening wall at least partially defining the first opening; and wherein in at least one rotational position of the first grinding disc relative to the distance bushing, the opening wall terminates flush with a face of the distance bushing.

14. The agitator ball mill of claim 9, wherein the distance bushing has a polygonal cross-sectional shape in a plane perpendicular to the axis of the agitator shaft.

15. The agitator ball mill of claim 14, wherein the distance bushing has a square cross-sectional shape in the plane perpendicular to the axis of the agitator shaft.

16. The agitator ball mill of claim 9, wherein the first grinding disc includes a radial recess and the second grinding disc includes a radial recess.

* * * * *